US005779069A

United States Patent [19]

Scully

[11] Patent Number: 5,779,069

[45] Date of Patent: Jul. 14, 1998

[54] REINFORCED SHELVES

[75] Inventor: Geoffrey B. Scully, Tecumseh, Mich.

[73] Assignee: Adrian Fabricators, Inc., Adrian, Mich.

[21] Appl. No.: 680,537

[22] Filed: Jul. 9, 1996

[51] Int. Cl.[6] ..... A47B 43/00

[52] U.S. Cl. ..... 211/153; 211/187; 248/250

[58] Field of Search ..... 211/153, 124, 211/181, 182, 204, 206, 123, 33.3; 108/180, 181, 193; 248/175, 249, 248, 247, 250, 300

[56] References Cited

U.S. PATENT DOCUMENTS

| | | | |
|---|---|---|---|
| 2,809,002 | 10/1957 | Rudolph | 211/123 X |
| 3,086,659 | 4/1963 | Cassel et al. | 211/153 |
| 3,298,503 | 1/1967 | Field et al. | 211/123 X |
| 3,403,787 | 10/1968 | Browning | 211/124 |
| 3,743,106 | 7/1973 | Maziarka et al. | 211/123 |
| 3,773,184 | 11/1973 | Brennan | 211/123 |
| 4,293,076 | 10/1981 | Collin | 211/7 X |
| 4,558,647 | 12/1985 | Petersen | 108/107 |
| 4,624,376 | 11/1986 | Bertram | 248/250 |
| 4,783,035 | 11/1988 | Remmers | 248/250 |
| 5,257,794 | 11/1993 | Nakamura | 211/182 X |
| 5,390,803 | 2/1995 | McAllister | 211/153 |
| 5,407,084 | 4/1995 | Remmers | 211/182 X |

*Primary Examiner*—Ramon O. Ramirez
*Assistant Examiner*—Anita M. King
*Attorney, Agent, or Firm*—Young & Basile, P.C.

[57] ABSTRACT

The invention provides an improved storage rack having wire mesh grid shelf and at least one traverse beam and a support channel for the wire mesh grid shelf having an inverted U-shaped configuration and having end portions that flair out to an essentially horizontal position to rest on a top ledge of the traverse beam. The end portions are die-formed to include grids running longitudinally on the end portions to strengthen thereon.

3 Claims, 2 Drawing Sheets

REINFORCED SHELVES

BACKGROUND OF THE INVENTION

The present invention relates to storage racks, and particularly for wire mesh storage racks having channel supports mounted thereto.

In certain types of storage racks in material handling and storage systems, a storage bay may consist of front and rear transverse beams supported upon upright posts and a wire mesh shelf spanning and resting upon the top ledges of the respective front and rear beams. Decks, shelves, or pallets may be supported upon these wire mesh shelves. If the storage material is heavy, additional support beams may be spaced under the wire mesh shelf and span the length or width of the wire mesh shelf.

The traditional beams or channels used as a support for the wire mesh shelf were configured as a U-shaped channel having the opening facing upward. As a result, debris and other ingredients associated with the storage material would collect within the open U-shaped portion of the support channel. This spillage and collection within the storage racks are a particular problem in food storage warehouse facilities and other storage applications where cleanliness is vital and debris accumulation is undesirable. Therefore, it is desirable to manufacture a supported or reinforced shelf that eliminates the collection points for debris and, therefore, the need for costly maintenance of storage shelving.

SUMMARY OF THE INVENTION

The invention as described hereinafter addresses the aforementioned concerns. The invention is an improved storage bay supported by upright posts and having transverse beams extending between the posts in a planar configuration; and especially a storage bay having a wire mesh shelf with a support channel underneath the wire mesh shelf wherein the support channel has an inverted U-shaped configuration so that the U-shaped opening is facing downward. The end portions of each support channel are reconfigured to flair out into a horizontal planar configuration to allow the channel to rest upon the top ledges of the transverse beam which is attached to the upright posts. The transitional flared section between the U-shaped configuration and the horizontal planar configuration of the support channel is also configured to minimize the collection of debris thereon. By inverting the channel and flaring each end for attachment to a transverse beam, the accumulation of debris is avoided and the sanitation of a particular storage environment is significantly enhanced.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
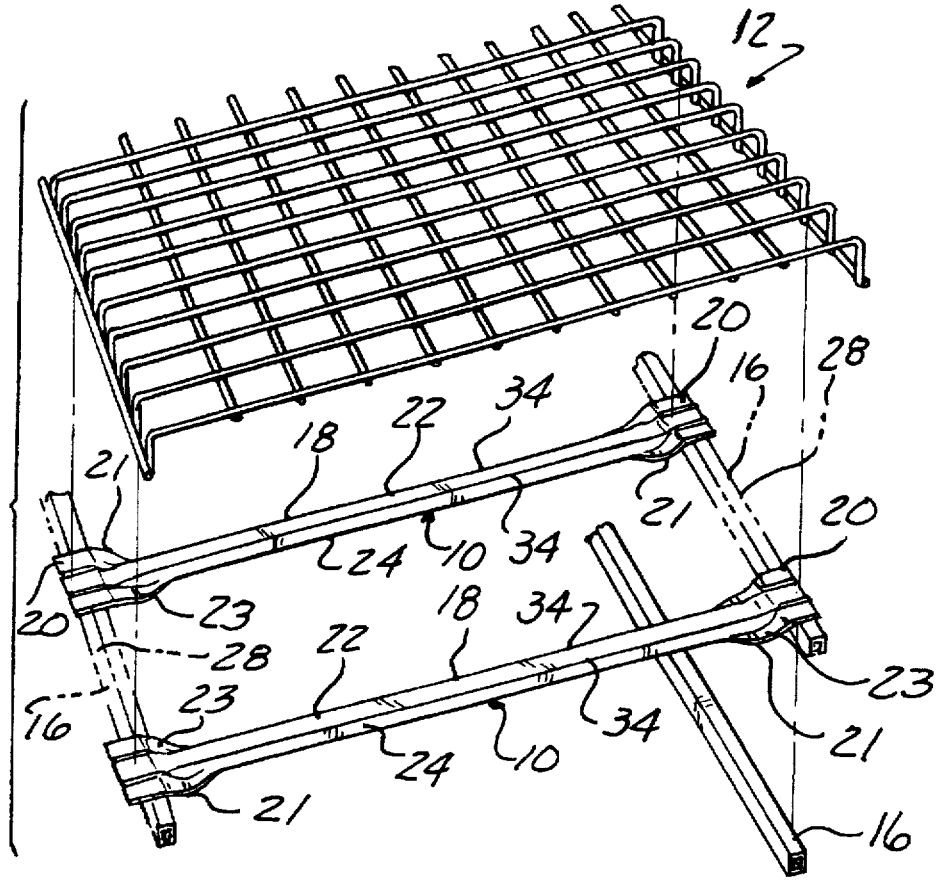
FIG. 1 is an exploded view of a wire mesh shelf having a pair of transverse beams located at each end and a pair of support channels made in accordance with the invention.

Looking at FIGS. 1–4, a support channel member 10 is provided for securing to an underside of a planar shelf member 12; and is especially useful when the planar shelf member 12 is a wire mesh configuration. FIG. 1 illustrates two such channel support members 10, although any number may be used for attachment to the planar shelf member 12 depending upon the size and weight of the storage material.

The channel support member 10 has an elongated center portion 18 disposed between two end portions 20. Proximate to each end portion 20 is a transitional flared section 21. The elongated center portion 18 is an inverted U-shaped configuration relative to the top of the wire mesh shelf 12 such that a top planar surface 22 of the elongated center portion 18 can be secured preferably by welding, to the wire mesh shelf 12 and has a pair of downwardly extending portions 24 extending therefrom. The top planar surface 22 and pair of downwardly extending portions 24 define a channel 26 therebetween.

Figure 4:
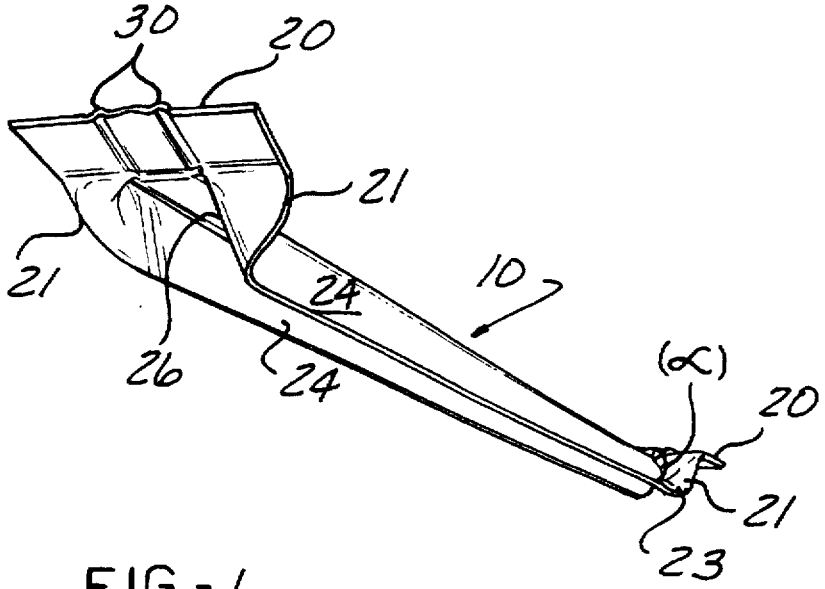
FIG. 4 is a perspective view of the support channel according to the invention.
Figure 2:
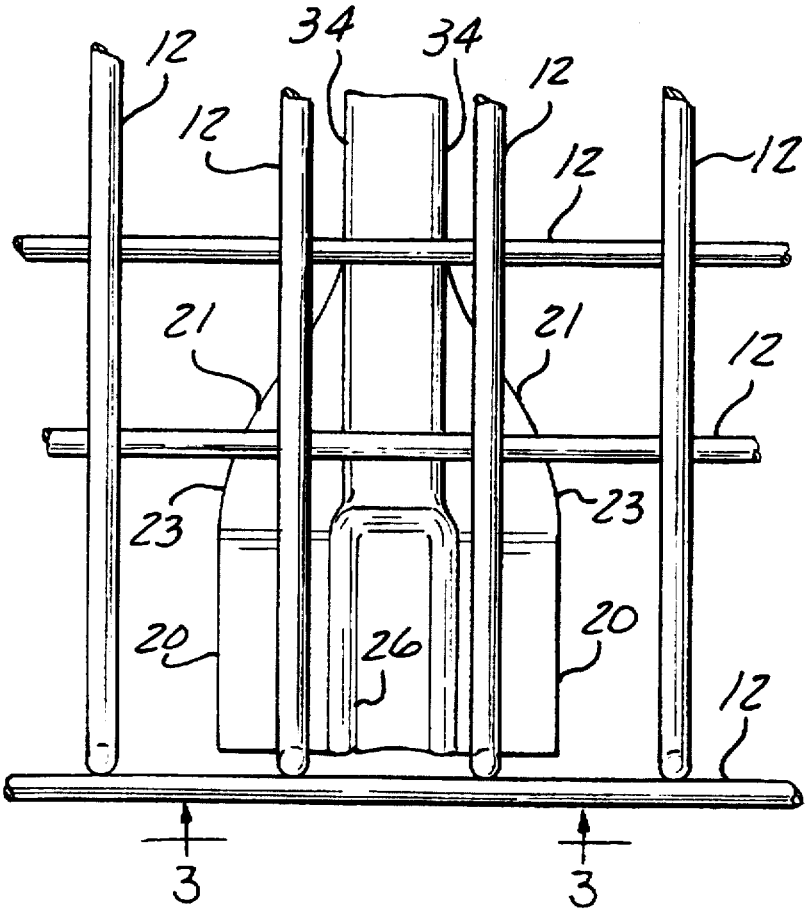
FIG. 2 is a fragmentary top plan view of a portion of the wire mesh shelf and one end of the support channel.
Figure 3:
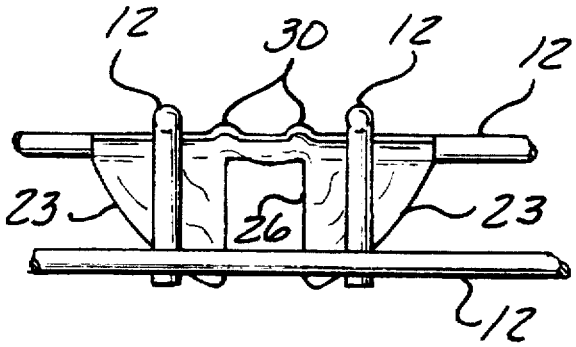
FIG. 3 is fragmentary front end view taken along line 3—3 of FIG. 2.

As seen in FIGS. 1, 2 and 4, the channel support member 10 is configured to have end portions 20 that are essentially flattened and configured to rest on a top ledge 28 of a transverse beam 16. Therefore, each channel support member 10 is sized to extend from one end of the wire mesh shelf 12 to another end as shown in FIG. 1. The traverse beam 16 sandwiches an upper surface of the flattened and horizontal end portion 20 against the wire mesh shelf 12, and a lower surface of the horizontal end portion 20 against the box-shaped transverse beam 16.

The transitional flared sections 21 and horizontal end portions 20 are shaped by die-forming the U-shaped support member 10 at each end. The transitional flared sections 21 include flares or wings 23 that curve downward at a 35 degree angle ($\alpha$) to eliminate all catch points for foreign debris, liquids and other product spillage. By inverting the channel 26 to face downward and die forming a flared section 21 proximate to each end portion 20, the accumulation of debris is avoided in the sanitation of a particular storage environment is significantly enhanced.

In the preferred embodiment, the flattened bearing surface of the end portion 20 is strengthened by two contour lines 30. The two contour lines 30 contiguously extend from the down-turned corners 34 of the inverted U-shaped center portion 18 of the support beam 10. The contour lines 30 extend only slightly above the horizontal end portion 20 so that the end portions 20 lay essentially flush against the transverse beam 16 without lateral movement.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A reinforced shelf comprising:

a shelf member;

at least one horizontal support bar having opposite end portions and a center portion;

said center portion of said at least one horizontal support bar having a top planar surface and a pair of side walls, and said top planar surface connected to said shelf member wherein said shelf member extends beyond the periphery of said top planar surface;

said pair of side walls extending downwardly from said top planar surface to form a longitudinal channel wherein said channel faces away from said shelf member;

said end portions having a substantially flat bearing surface lying in substantially the same plane as said top planar surface;

at least one contour line extending contiguously from the top planar surface through said end portions to strengthen said bearing surface; and said bearing surface supportable by a traverse beam, wherein said at least one contour line further comprises a semi-cylindrical raised contour formed in and extending along said bearing surface.

2. A reinforced shelf comprising:

a shelf member having a bottom planar surface;

at least one horizontal support bar having opposite end portions and a center portion disposed between said end portions;

said center portion having a top planar surface and a pair of side walls, and said top planar surface connected to said bottom planar surface of said shelf member wherein said shelf member extends beyond the periphery of said top planar surface;

said pair of side walls extending downardly from said top planar surface at substantially right angles to said top planar surface to form a U-shaped longitudinal channel wherein said channel faces away from said shelf member;

said end portions having a substantially flat bearing surface lying in substantially the same plan as said top planar surface;

said horizontal support bar having a flared section integrally connecting said side walls with said bearing surface; and a pair of substantially parallel contour lines extending contiguously from corners of said top planar surface through said end portions to strengthen said bearing surfaces, wherein each of said contour lines further comprise:

a semi-cylindrical raised contour formed in and extending substantially parallel to a longitudinal axis of said horizontal support bar.

3. A reinforced shelf comprising:

a shelf member having a bottom planar surface;

a pair of substantially parallel, similar horizontal support bars each having opposite end portions and a center portion disposed between said end portions, and each of said horizontal support bars having a longitudinal axis;

each of said center portions having a top planar surface and a pair of side walls, and said top planar surface connected to said bottom planar surface of said shelf member wherein said shelf member extends beyond the periphery of said top planar surface;

each of said side walls extending downwardly from said top planar surface at a substantially right angle to form a U-shaped longitudinal channel wherein said channel faces away from said shelf member;

said end portions having a substantially flat bearing surface lying in substantially the same plane as said top planar surface, and said bearing surface supportable by a transverse beam;

each of said horizontal support bars having a flared section integrally connecting said side walls with said bearing surfaces; and a pair of substantially parallel contour lines extending contiguously from corners of said top planar surface through said end portions to strengthen said bearing surface, wherein each of said contour lines further comprise:

a semi-cylindrical raised contour formed in and extending along said bearing surface substantially parallel to said longitudinal axis of said horizontal support bar.

* * * * *